US010039158B2

(12) United States Patent
Juvonen

(10) Patent No.: US 10,039,158 B2
(45) Date of Patent: Jul. 31, 2018

(54) PRESSURE RING ASSEMBLY FOR CONTACT SHOES IN AN ELECTRODE SYSTEM

(71) Applicant: OUTOTEC (FINLAND) OY, Espoo (FI)

(72) Inventor: Seppo Juvonen, Porvoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 69 days.

(21) Appl. No.: 14/912,770

(22) PCT Filed: Aug. 20, 2014

(86) PCT No.: PCT/FI2014/050639
§ 371 (c)(1),
(2) Date: Feb. 18, 2016

(87) PCT Pub. No.: WO2015/028706
PCT Pub. Date: Mar. 5, 2015

(65) Prior Publication Data

US 2016/0198531 A1 Jul. 7, 2016

(30) Foreign Application Priority Data

Aug. 27, 2013 (FI) ..... 20135863

(51) Int. Cl.
*H05B 7/10* (2006.01)
*H05B 7/105* (2006.01)
(Continued)

(52) U.S. Cl.
CPC ..... *H05B 7/105* (2013.01); *F27B 3/085* (2013.01); *F27D 11/08* (2013.01); *F27D 11/10* (2013.01);
(Continued)

(58) Field of Classification Search
CPC . H05B 7/06; H05B 7/085; H05B 7/10; H05B 7/11; H05B 7/14; H05B 7/102;
(Continued)

(56) References Cited

U.S. PATENT DOCUMENTS 2,884,475 A * 4/1959 Foyn ..... H05B 7/105 373/100
4,323,717 A * 4/1982 Garner ..... H05B 7/103 373/101

FOREIGN PATENT DOCUMENTS

CN 1926923 A 3/2007
CN 102455131 A 5/2012
(Continued)

OTHER PUBLICATIONS

International Search Report (PCT/ISA/210) dated Feb. 4, 2015, by the European Patent Office as the International Searching Authority for International Application No. PCT/FI2014/050639.
(Continued)

*Primary Examiner* — Hung D Nguyen
(74) *Attorney, Agent, or Firm* — Buchanan, Ingersoll & Rooney PC

(57) ABSTRACT

Provided is a pressure ring assembly for contact shoes in an electrode system of an electric arc furnace provided with at least one electrode column assembly. The electrode column assembly comprises a contact shoe ring formed of a plurality of contact shoe elements, a pressure ring formed of a plurality of pressure blocks, and a heat shield formed of a plurality of heat shield segments. An elongated groove is formed on both substantially vertical side edges of each pressure block, and an elongated lock bar is placed in the grooves of two adjacent pressure blocks to join said pressure blocks with each other. The form of the lock bar essentially matches to the form of the grooves of said two adjacent
(Continued)

pressure blocks. Each lock bar is locked in place in the grooves by fastening bolts through holes in the pressure blocks.

6 Claims, 4 Drawing Sheets

(51) Int. Cl.
*F27B 3/08* (2006.01)
*F27D 11/08* (2006.01)
*F27D 11/10* (2006.01)
*F27D 99/00* (2010.01)

(52) U.S. Cl.
CPC ..... *H05B 7/10* (2013.01); *F27D 2099/0021* (2013.01)

(58) Field of Classification Search
CPC ..... H05B 7/103; H05B 7/105; H05B 7/107; H05B 7/109; F27B 3/08; F27B 3/085; F27B 3/10; F27B 3/24; F27D 11/08; F27D 11/10; F27D 2099/0021
USPC ..... 373/95, 96, 97, 98, 99, 100; 1/88, 94, 1/95, 96, 97, 98, 99, 100
See application file for complete search history.

(56) References Cited

FOREIGN PATENT DOCUMENTS

| | | | |
|---|---|---|---|
| DE | 518 332 | A | 2/1931 |
| DE | 31 44 437 | A1 | 6/1983 |
| EP | 1 971 190 | A2 | 9/2008 |
| WO | 03/069956 | A1 | 8/2003 |
| WO | WO 2014/096540 | A1 | 6/2014 |
| ZA | 9 903 870 | A | 2/2001 |
| ZA | 200 300 504 | A | 9/2003 |
| ZA | 200 501 486 | A | 9/2005 |

OTHER PUBLICATIONS

Written Opinion (PCT/ISA/237) dated Feb. 4, 2015, by the European Patent Office as the International Searching Authority for International Application No. PCT/FI2014/050639.
International Preliminary Report on Patentability (PCT/IPEA/409) dated Nov. 24, 2015, by the European Patent Office as the International Searching Authority for International Application No. PCT/FI2014/050639.
Office Action dated Apr. 28, 2017, by the State Intellectual Property Office of the People's Republic of China in corresponding Chinese Patent Application No. 201480046315.8, and an English translation of the Office Action. (17 pages).

* cited by examiner

PRESSURE RING ASSEMBLY FOR CONTACT SHOES IN AN ELECTRODE SYSTEM

FIELD OF THE INVENTION

The present invention relates to a pressure ring assembly for contact shoes in an electrode system of an electric arc furnace. More specifically, the invention relates to a pressure ring assembly for contact shoes in an electrode system of an electric arc furnace provided with at least one electrode column assembly, the lower part of which electrode column assembly comprises a contact shoe ring formed of a plurality of contact shoe elements, a pressure ring formed of a plurality of pressure blocks connected to each other to form an annular ring surrounding the contact shoe ring, the pressure blocks of said pressure ring being provided with hydraulic bellows by which the contact shoe ring is pressed against the steel mantle of the electrode, and a heat shield located above the pressure ring in the axial direction of the electrode column assembly, said heat shield formed of a plurality of heat shield segments connected to each other.

BACKGROUND OF THE INVENTION

An electric arc furnace is an electrically operated furnace used for melting metal and/or for cleaning slag. The operation of the furnace is based on an arc flame that burns either between separate electrodes, or between electrodes and the material to be melted. The furnace may be operated either by AC or DC current. Heat is created in the arc flame, and also in the material to be melted, in case the arc flame burns between the material and the electrodes. Power is conducted to vertical electrodes that are located symmetrically in a triangle with respect to the midpoint of the furnace. In the case of a DC smelting furnace there is one electrode in the middle of the furnace. The assembly depth of the electrodes in the furnace is continuously adjusted, because they are worn at the tips owing to the arc flame.

The lower part of the electrode column assembly comprises a contact shoe ring, a pressure ring and a heat shield. The contact shoe ring consists of a plurality of contact shoe elements arranged as a ring to be in contact with a steel mantle inside of which the electrode paste is sintered. Such an electrode is a so-called Soderberg electrode. The contact shoe elements conduct electric current to the electrode. A pressure ring is arranged on the outside of the contact shoe ring, so that the contact shoe ring is surrounded by said pressure ring. The pressure ring consists of a plurality of pressure blocks connected with each other as a ring, which pressure blocks being provided with hydraulic bellows by which the contact shoes in the contact shoe ring are pressed against the steel mantle of the electrode. A heat shield surrounding the electrode column assembly is arranged above the pressure ring in the axial direction of the electrode column assembly. Also the heat shield is comprised of a plurality of segments connected with each other to form an assembly of annular form.

As mentioned above, the pressure ring consists of a plurality of pressure blocks connected with each other as a ring. The pressure blocks are commonly made of massive copper elements. In current systems the connections between the pressure blocks are quite often manufactured so that shoulders or ridges are machined in the side edges of the copper elements. So, in this kind of arrangement, in the manufacturing stage, extra copper material must be reserved of the copper cast molding, half of which extra material must be cut away to obtain a shoulder. Therefore material is wasted.

Through holes for bolts or screws are made in the above mentioned shoulders and the adjacent pressure blocks are connected to each other by said bolts or screws. This causes a disadvantage or drawback because the high tensile stress prevailing in the pressure ring is directed to the shearing stress of the bolts. Therefore it is very likely that in use cleavage will occur in the seams between adjacent pressure blocks.

Another drawback will become obvious when a single contact shoe must be changed. Due to the shoulders three pressure blocks must be detached to change a single contact shoe.

With further reference to prior art document EP1971190 shows a pressure ring assembly in which adjacent pressure blocks are connected to each other with a separate connecting means. For said connecting means grooves are machined on the side edges of the pressure blocks and the connecting means is pushed in said grooves from above. The connecting means has a tapering form in the longitudinal direction of it and therefore it is very difficult to detach the connecting means after it has been mounted in place.

OBJECTIVE OF THE INVENTION

An objective of the present invention is to provide a novel pressure ring assembly for contact shoes in an electrode system of an electric arc furnace which overcomes the disadvantages and drawbacks relating to prior art.

SUMMARY OF THE INVENTION

The objectives of the present invention are attained by the pressure ring assembly, mainly characterized in that an elongated groove is formed on both substantially vertical side edges of each pressure block, so that in two adjacent pressure blocks said grooves are facing and opening towards each other, said grooves being wider at the bottom of the grooves than at the side edges of the pressure blocks, that an elongated lock bar is placed in the grooves of two adjacent pressure blocks to join said pressure blocks with each other, each lock bar being transverse to its longitudinal direction thicker at its both sides than in the middle, so that the form of the lock bar essentially matches to the form of the grooves of said two adjacent pressure blocks, and that each lock bar is locked in place in the grooves by fastening bolts through holes in the pressure blocks.

Preferably, both the lock bars and the grooves are provided with bezels matching each other to form a dove-tail like joint between them. The matching bezels are pressed against each other when the fastening bolts are tightened, so that in the joint formed thereby forces are transmitted through the bezels to the lock bar.

The grooves in the side edges of the pressure blocks extend from the upper end of each pressure block downwards near to the bottom end of the same where said grooves are closed by a shoulder.

The lock bars are made of antimagnetic material, preferably austenitic steel.

The fastening bolts extend from the outer surface of each pressure block to the lock bar into which said fastening bolts are threaded. The fastening bolts and the holes made for them in the pressure blocks are covered with caps.

Among the advantages attained by the invention can be mentioned that the tightness of the pressure ring assembly is much better than in prior art arrangements. The tightness is very important because the content of carbon dioxide in the furnace must be sufficient. Another advantage attained by the invention is that the replacement of the pressure blocks requires much less work and is much easier than before. Further, in earlier furnace constructions there was a risk that the electrode could fall into the furnace. The present invention minimizes such risk. Also the contact shoes under the pressure ring can be replaced easier than before and for the replacement of a single contact shoe only one pressure block has to be removed while the same replacement required removal of three adjacent pressure blocks in prior art arrangements.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1:
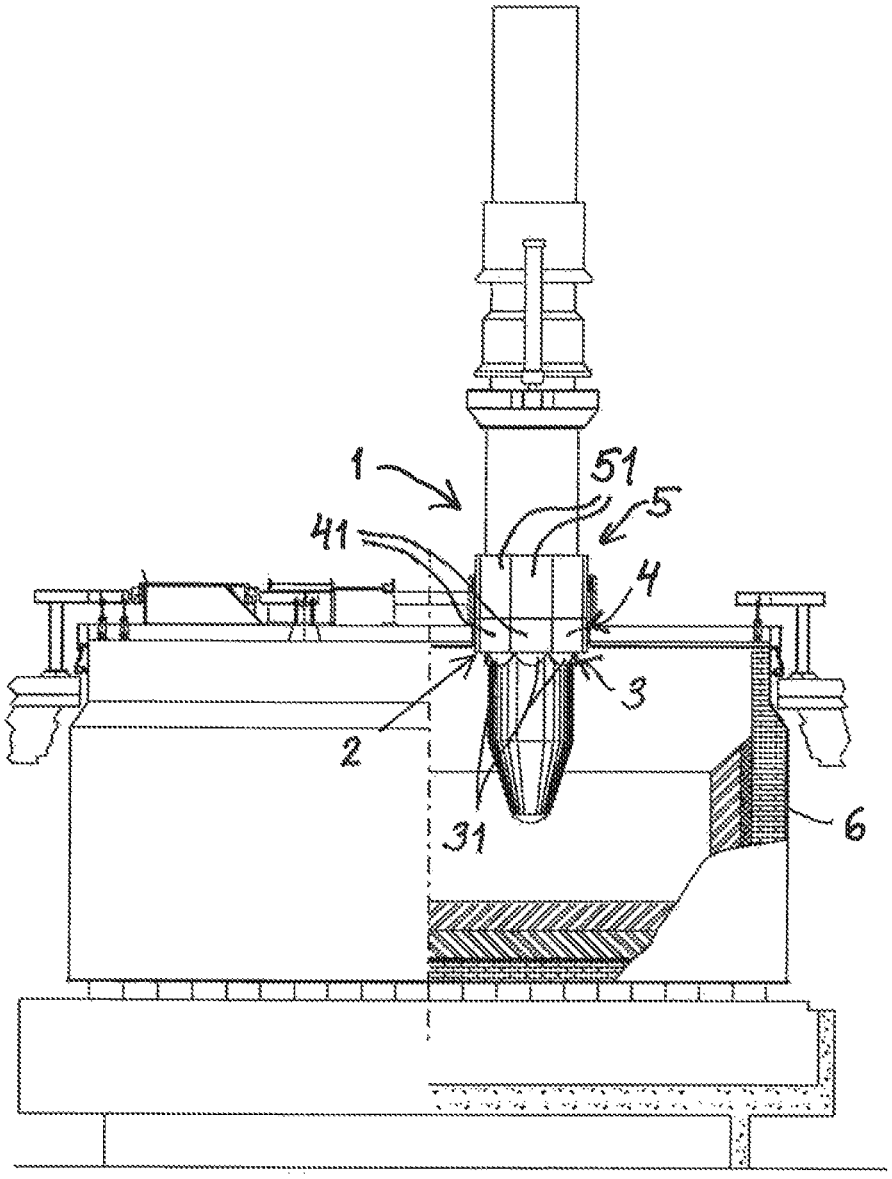
FIG. 1 is a schematic elevation side view of an electric arc furnace.

FIG. 1 shows a schematic illustration of an electric arc furnace 6. The furnace 6 comprises a plurality of electrode column assemblies 1, but for the sake of simplicity only one of them is shown in FIG. 1.

Figure 2:
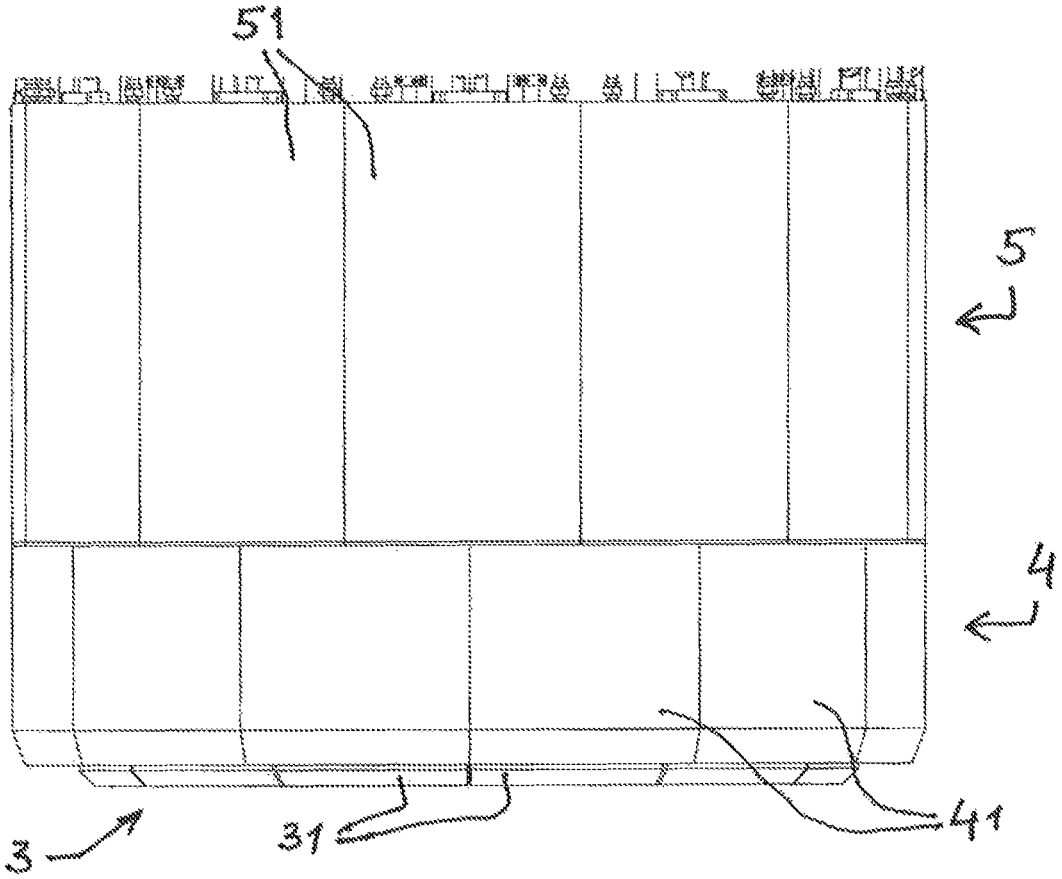
FIG. 2 is schematic elevation side view of a lower electrode column assembly of the electric arc furnace of FIG. 1 in a larger scale.
Figure 3:
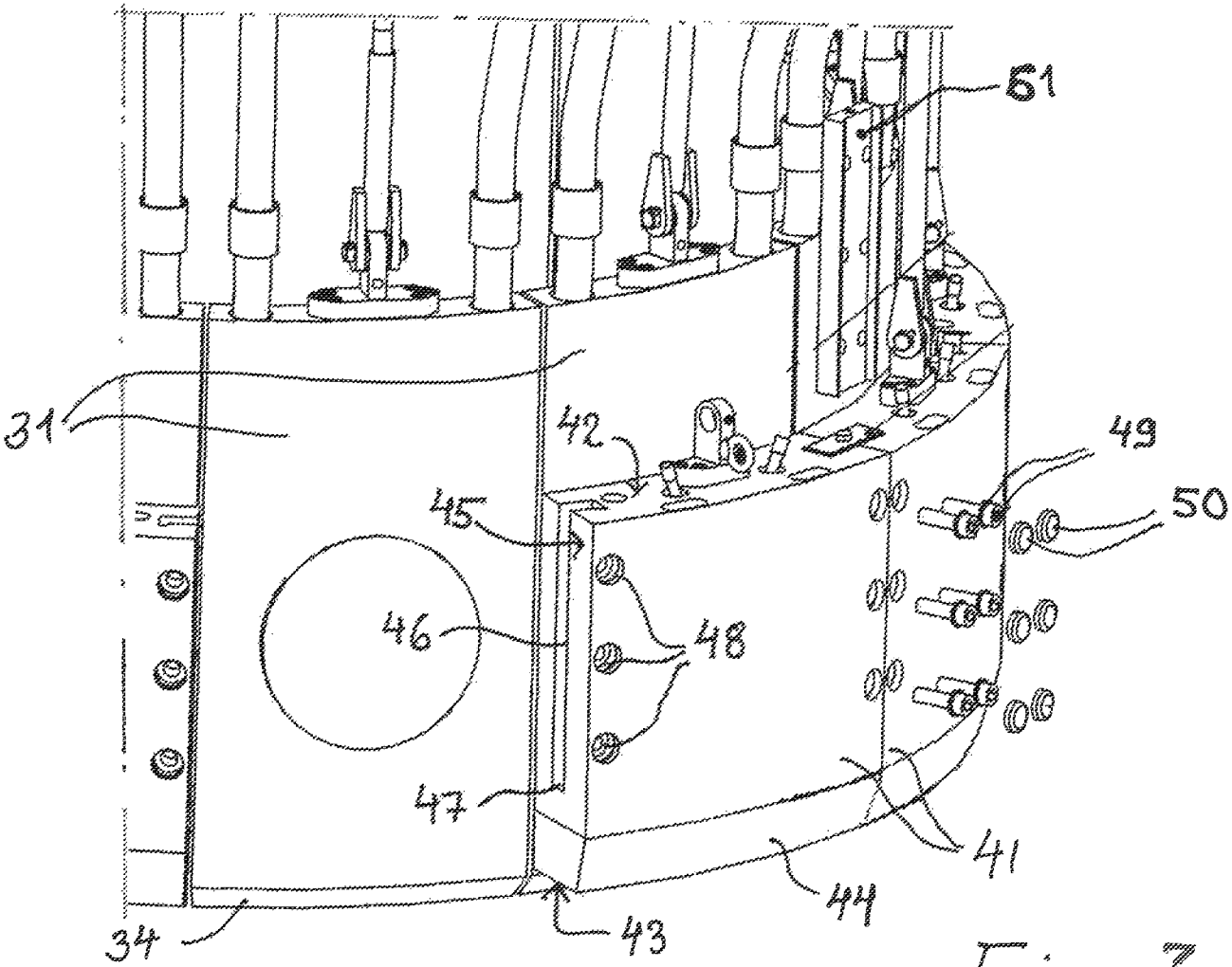
FIG. 3 is an axonometric view of a part or the lower electrode column assembly.

With reference to FIGS. 1, 2 and 3 an electrode lower column assembly 2 is located in the lower part of the electrode system. The electrode lower column assembly 2 comprises a contact shoe ring 3, a pressure ring 4 and a heat shield 5. The contact shoe ring 3 is configured to be placed in contact with the electrode to conduct electric current to the electrode. The contact shoe ring 3 comprises a plurality of contact shoe elements 31. The contact shoe elements 31 are arranged in an annular form to surround the electrode. The contact shoes 31 are pressed against the steel mantle of the electrode with the aid of a plurality of hydraulic bellows arranged in the pressure ring 4 that surrounds the contact shoe ring 3. The pressure ring 4 comprises a plurality of pressure blocks 41 connected to each other to form an annular ring. Preferably each of the pressure blocks 41 is provided with a hydraulic bellow as mentioned above. A heat shield 5 is located above the pressure ring 4 in the axial direction of the electrode column assembly 1. The heat shield 5 comprises a plurality of heat shield segments 51 connected to each other to form an annular ring surrounding the lower electrode column assembly 2.

Figure 4:
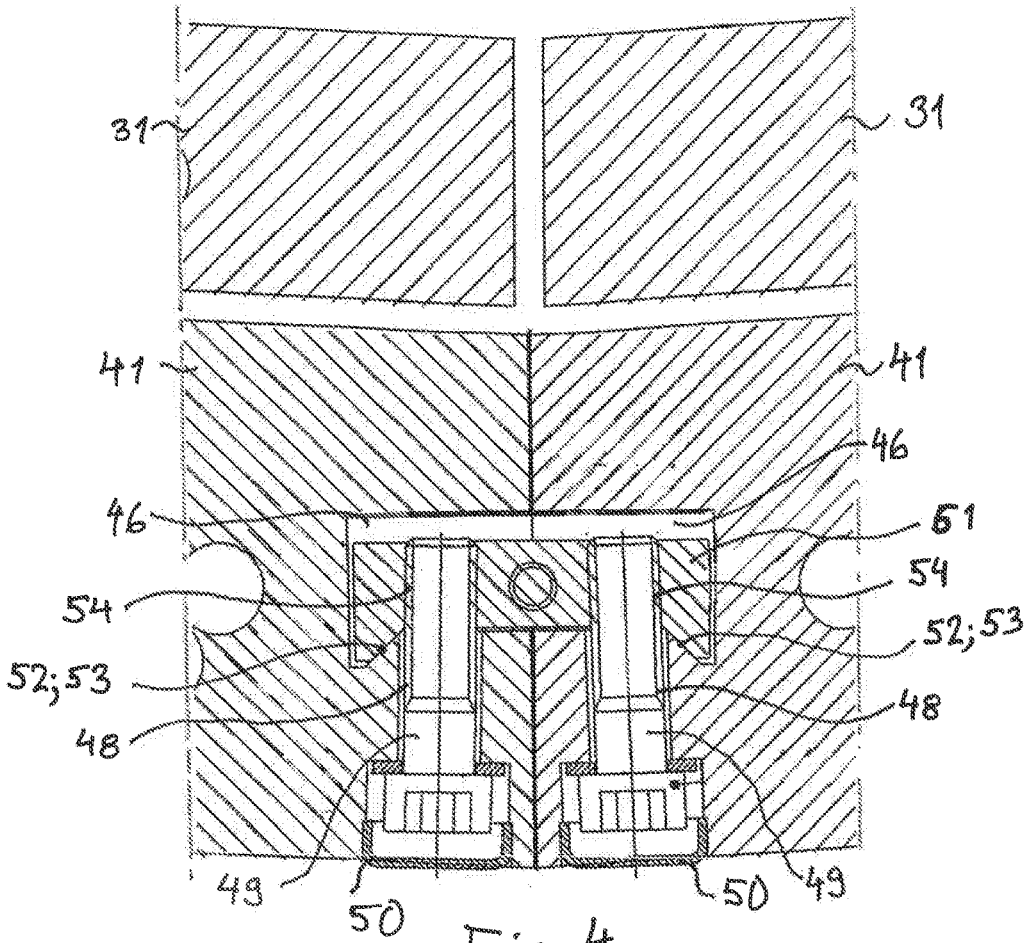
FIG. 4 is a cross-sectional view of an arrangement for connecting the pressure shoes to each other.

As it can best be seen in FIGS. 3 and 4 a groove 46 is made on both side edges 45 of each pressure block 41. The grooves 46 are open upwards and they extend from the upper ends 42 of the pressure blocks 41 near to the bottom ends 43 of the same. So, in each adjacent two pressure blocks 41 the grooves 46 are opening towards each other. An elongated lock bar 61 is placed in said grooves 46 to join the adjacent pressure blocks 41 with each other. In order to ensure the tightness of the fitting between the lock bar 61 and the grooves 46 in the adjacent pressure blocks 41 said grooves 46 do not extend vertically through the pressure blocks 41 from the upper end 42 to the bottom end of the pressure blocks 41 but downwards said grooves 46 are closed with a shoulder 47 near the bottom end 43 of the pressure blocks 41. Holes 48 have been made in the pressure blocks 41, said holes extending from the outer face of the pressure blocks 41 into said grooves 46. Preferably a multiple of such holes 48 are provided for each groove 46. Corresponding holes 54 have been made in the lock bars 61, which holes 51 are provided with threads for fastening bolts 49. So, the lock bars 61 are locked in place in the grooves 46 by the fastening bolts 49 through the holes 48 in the pressure blocks 41.

Figure 5:
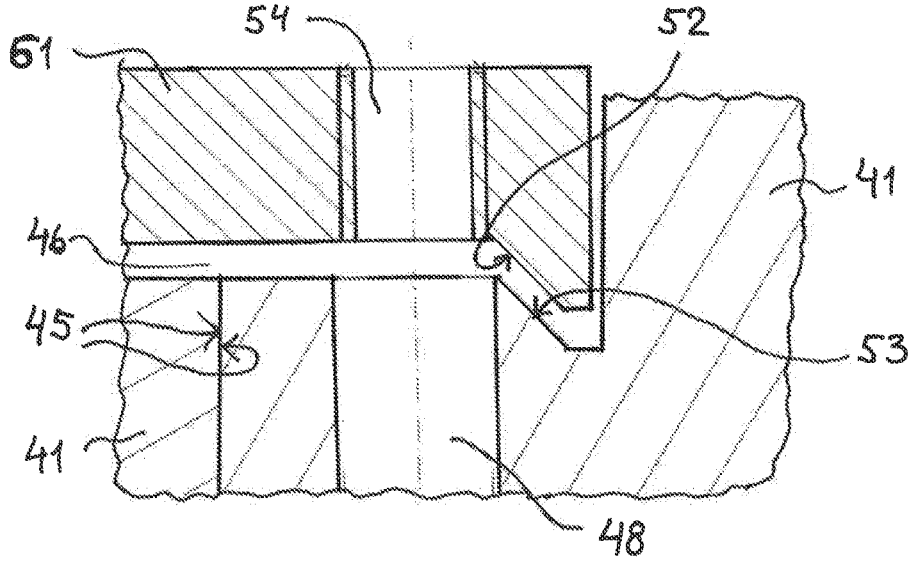
FIG. 5 is a detail from FIG. 4 in a larger scale.

Now referring especially to FIGS. 4 and 5, both the grooves 46 in the pressure blocks 41 and the lock bars 61 have a specific configuration. In the circumferential direction of the pressure blocks 41 the grooves 46 are wider at the bottom of the grooves than at the side edges 45 of the pressure blocks 41. The lock bars are form in a similar way so that transverse to their longitudinal direction they are thicker at their both sides than in the middle and further so that their form match to the form of the grooves 46 of two adjacent pressure blocks 41. So, the lock bars 61 together with the grooves 46 form a dove-tail like joint. More specifically, both the lock bars 61 and the grooves 46 are provided with matching bezels 52, 53. When tightening the fastening bolts 49 said bezels 52, 53 are pressed to each other, whereby in the joint the forces go through the bezels 52, 53 to the bar, instead of giving transverse strain to the fastening bolts 49. Because of the large area of the bezels 52, 53 surface pressures remain at a low level.

The lock bars 61 are made of antimagnetic material, and one preferable material alternative is austenitic steel. The holes 48 and the fastening bolts 49 therein are from the outer surface of the pressure blocks 41 covered with caps 50 which preferably are made of the same material as the pressure blocks 41, preferably copper.

The contact shoe elements 31 are made of a material having good electrical and thermal conductivity. Further, the mechanical strength of the material must be high. E.g. copper is a material which fulfils these properties. Copper is a massive material which is very well applicable for the contact shoe elements 31. Other materials that could be used for this purpose are e.g. brass and bronze. Also other materials having corresponding properties can be used. Preferably the pressure blocks 41 are made of the same material as the contact shoe elements 31.

It is obvious to a person skilled in the art that with the advancement of technology, the basic idea of the invention may be implemented in various ways. The invention and its embodiments are thus not limited to the examples described above, instead they may vary within the scope of the claims.

The invention claimed is:

1. A pressure ring assembly for contact shoes in an electrode system of an electric arc furnace provided with at least one electrode column assembly, the lower part of which electrode column assembly comprises a contact shoe ring formed of a plurality of contact shoe elements, a pressure ring formed of a plurality of pressure blocks connected to each other to form an annular ring surrounding the contact shoe ring, the pressure blocks of said pressure ring being provided with hydraulic bellows by which the contact shoe ring is pressed against the steel mantle of the electrode, and a heat shield located above the pressure ring in the axial direction of the electrode column assembly, said heat shield formed of a plurality of heat shield segments connected to each other, wherein an elongated groove is formed on both substantially vertical side edges of each pressure block, so that in two adjacent pressure blocks said grooves are facing and opening towards each other, said grooves being wider at the bottom of the grooves than at the side edges of the pressure blocks, that an elongated lock bar is placed in the grooves of two adjacent pressure blocks to join said pressure blocks with each other, each lock bar being transverse to its longitudinal direction thicker at its both sides than in the middle, so that the form of the lock bar essentially matches to the form of the grooves of said two adjacent pressure blocks, and that each lock bar is locked in place in the grooves by fastening bolts through holes in the pressure blocks, wherein both the lock bars and the grooves are provided with bezels matching each other to form a dove-tail like joint between them, wherein the fastening bolts extend from the outer surface of each pressure block to the lock bar into which said fastening bolts are threaded.

2. The pressure ring assembly as claimed in claim 1, wherein the matching bezels are pressed against each other when the fastening bolts are tightened, so that in the joint formed thereby forces are transmitted through the bezels to the lock bar.

3. The pressure ring assembly as claimed in claim 1, wherein the grooves in the side edges of the pressure blocks extend from the upper end of each pressure block downwards near to the bottom end of the same where said grooves are closed by a shoulder.

4. The pressure ring assembly as claimed in claim 1, wherein the lock bar is made of antimagnetic material.

5. The pressure ring assembly as claimed in claim 4, wherein the material of the lock bar is austenitic steel.

6. The pressure ring assembly as claimed in claim 1, wherein the fastening bolts and the holes made for them in the pressure blocks are covered with caps.

* * * * *